US006802730B2

(12) United States Patent
Chang

(10) Patent No.: US 6,802,730 B2
(45) Date of Patent: Oct. 12, 2004

(54) SEPARATION DEVICE OF AN ELECTRONIC STABILIZER BODY AND A FIXING SEAT

(75) Inventor: Chung-Min Chang, Taichung (TW)

(73) Assignee: Rhine Electronic Co., Ltd., Taichung (TW)

( * ) Notice: Subject to any disclaimer, the term of this patent is extended or adjusted under 35 U.S.C. 154(b) by 59 days.

(21) Appl. No.: 10/216,903

(22) Filed: Aug. 13, 2002

(65) Prior Publication Data

US 2004/0033713 A1 Feb. 19, 2004

(51) Int. Cl.[7] ..... H01R 33/02
(52) U.S. Cl. ..... 439/236; 439/333
(58) Field of Search ..... 439/236, 306, 439/308, 309, 333

(56) References Cited

U.S. PATENT DOCUMENTS 2,890,434 A * 6/1959 Ray ..... 439/321
4,623,823 A * 11/1986 Engel ..... 315/58
6,190,191 B1 * 2/2001 Pasternak ..... 439/236

* cited by examiner

*Primary Examiner*—Phuong Dinh
(74) *Attorney, Agent, or Firm*—Rosenberg, Klein & Lee

(57) ABSTRACT

A separation device of an electronic ballast body and a fixing seat includes a body, an electronic ballast, a socket, a fixing seat, and two safety locking members. The body has an inner wall formed with a receiving chamber for receiving the electronic ballast and the socket which is rested on the electronic ballast. The fixing seat has one end locked on a closed end of the body. Each of the two safety locking members is mounted and locked between the body and the fixing seat, so that the body and the fixing seat may be locked with each other, thereby integrally combining the body with the fixing seat. Thus, the separation device may be assembled and disassembled easily and conveniently, thereby facilitating replacement and maintenance of the separation device of the present invention.

16 Claims, 8 Drawing Sheets

SEPARATION DEVICE OF AN ELECTRONIC STABILIZER BODY AND A FIXING SEAT

BACKGROUND OF THE INVENTION

1. Field of the Invention

The present invention relates to a separation device of an electronic stabilizer body and a fixing seat, and more particularly to a separation device that may be assembled and disassembled easily and conveniently, thereby facilitating replacement and maintenance of the separation device of the present invention.

2. Description of the Related Art

A conventional lamp having an electronic stabilizer in accordance with the prior art shown in FIG. 8 comprises a shade seat 91, a shade 93 mounted on the bottom of the shade seat 91, a fixing device 92 mounted in the shade seat 91, a lamp rack 90 mounted on the shade seat 91 and having a distal end connected to the fixing device 92, and a lamp body 94 mounted in the shade 93 and connected to the fixing device 92. The fixing device 92 contains an electronic stabilizer therein. the fixing device 92 is connected with an electric wire 920 which is connected to a junction box 95 of the ceiling fan through the lamp rack 90.

However, the conventional lamp having an electronic stabilizer in accordance with the prior art has the following disadvantages.

1. The electronic stabilizer mounted in the fixing device 92 that is hidden in the shade 93 is easily worn out. Thus, when the electronic stabilizer is worn out, the user has to detach the lamp body 94, then detach the shade 93 from the shade seat 91, thereby exposing the fixing device 92, and then detach and replace the entire fixing device 92. Then, the user has to mount a new fixing device 92 in the shade seat 91, then mount the shade 93 in the shade seat 91, and then mount the lamp body 94. Thus, it takes a long time and much manual work to replace the fixing device 92, thereby greatly increasing inconvenience and difficulty in maintenance of the fixing device 92.

2. The fixing device 92 is connected to the electric wire 920. Thus, when the electronic stabilizer in the fixing device 92 is worn out, the user has to detach the shade seat 91 and the shade 93, and to detach the fixing device 92 from the electric wire 920 for replacing the fixing device 92 and the electronic stabilizer in the fixing device 92, thereby easily causing danger in maintenance of the fixing device 92.

3. The user has to replace the entire fixing device 92 when the electronic stabilizer or other parts contained in the fixing device 92 is worn out, thereby causing improper consumption of material and increasing the cost, and thereby easily causing an environmental pollution.

SUMMARY OF THE INVENTION

The present invention has arisen to mitigate and/or obviate the disadvantage of the conventional lamp.

The primary objective of the present invention is to provide a separation device of an electronic stabilizer body and a fixing seat, wherein the separation device may be assembled and disassembled easily and conveniently, thereby facilitating replacement and maintenance of the separation device of the present invention.

In accordance with the present invention, there is provided a separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body; and each of the two safety locking members is mounted and locked between the body and the fixing seat, so that the body and the fixing seat may be locked with each other, thereby integrally combining the body with the fixing seat.

Further benefits and advantages of the present invention will become apparent after a careful reading of the detailed description with appropriate reference to the accompanying drawings.

DETAILED DESCRIPTION OF THE INVENTION

Figure 1:
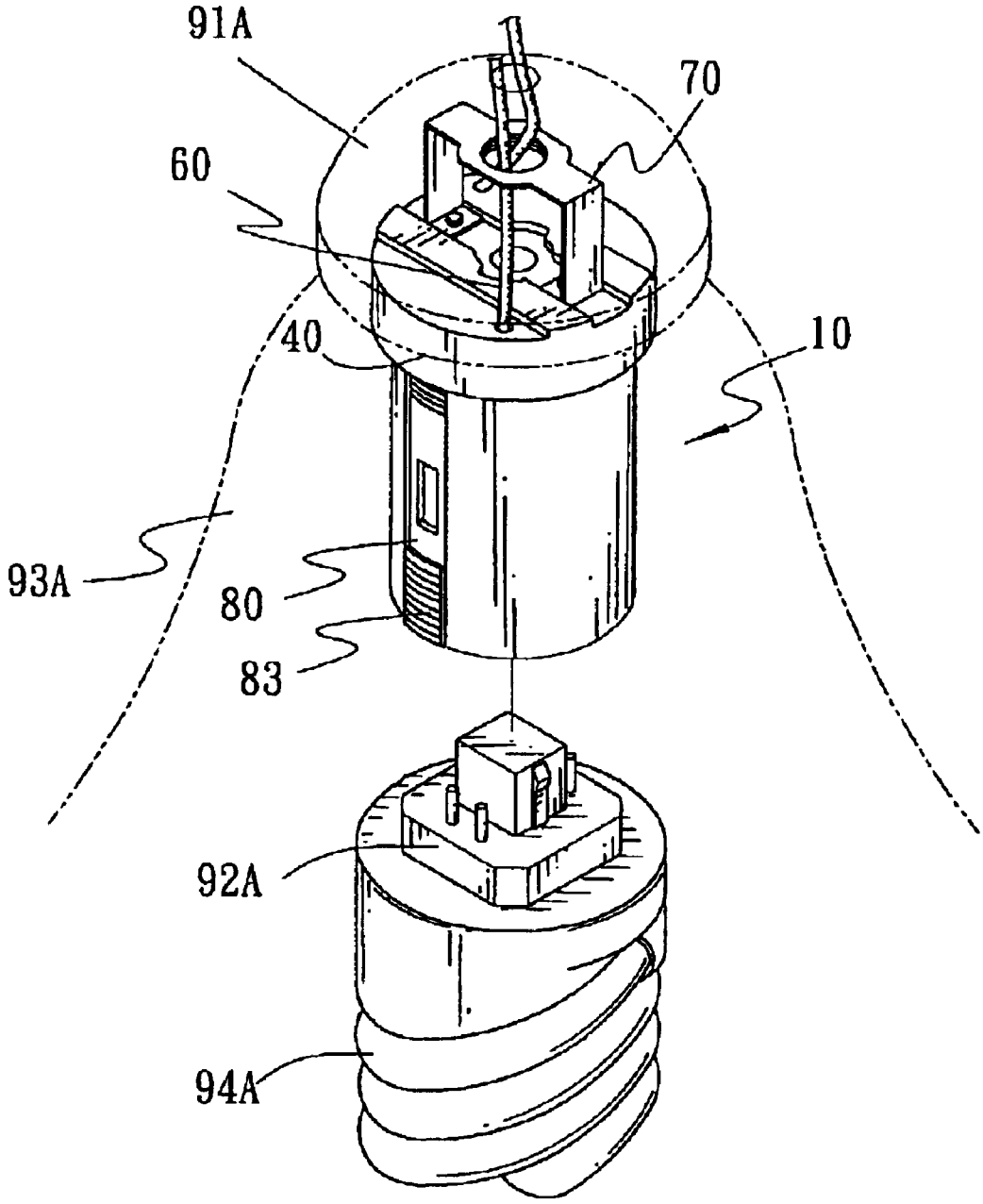
FIG. 1 is a perspective view of a separation device of an electronic stabilizer body and a fixing seat in accordance with a first embodiment of the present invention.
Figure 2:
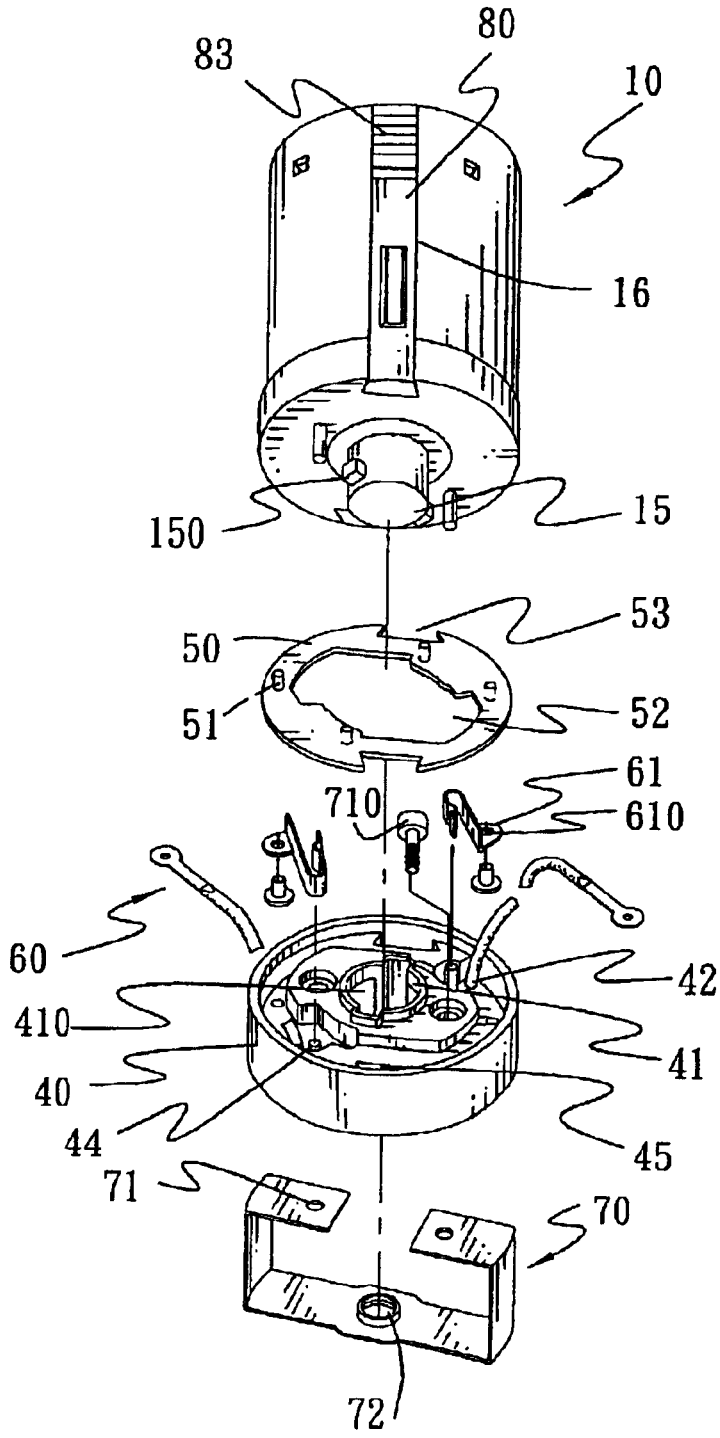
FIG. 2 is a partially exploded perspective view of the separation device of an electronic stabilizer body and a fixing seat in accordance with the first embodiment of the present invention.
Figure 3:
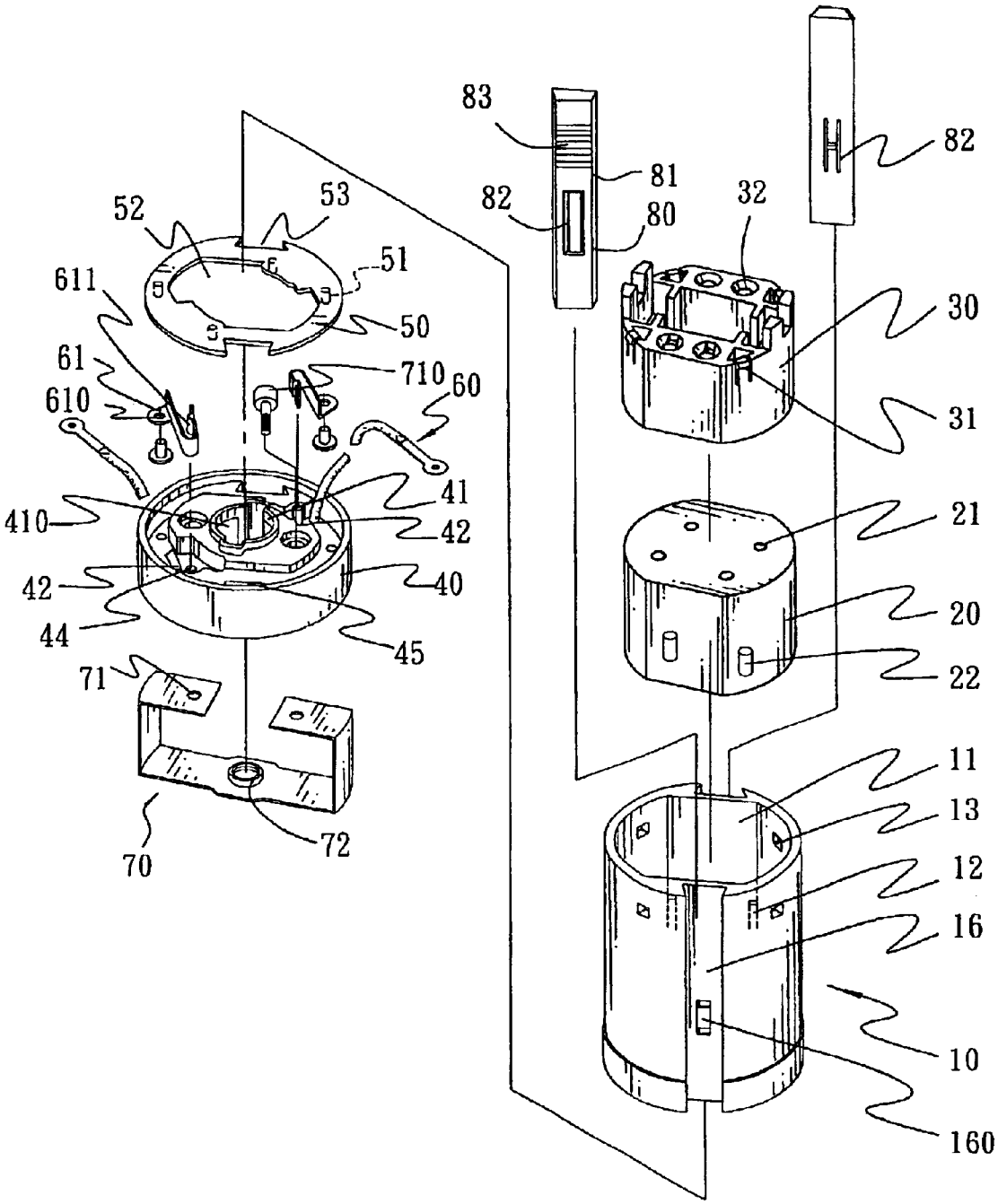
FIG. 3 is an exploded perspective view of the separation device of an electronic stabilizer body and a fixing seat in accordance with the first embodiment of the present invention.
Figure 4:
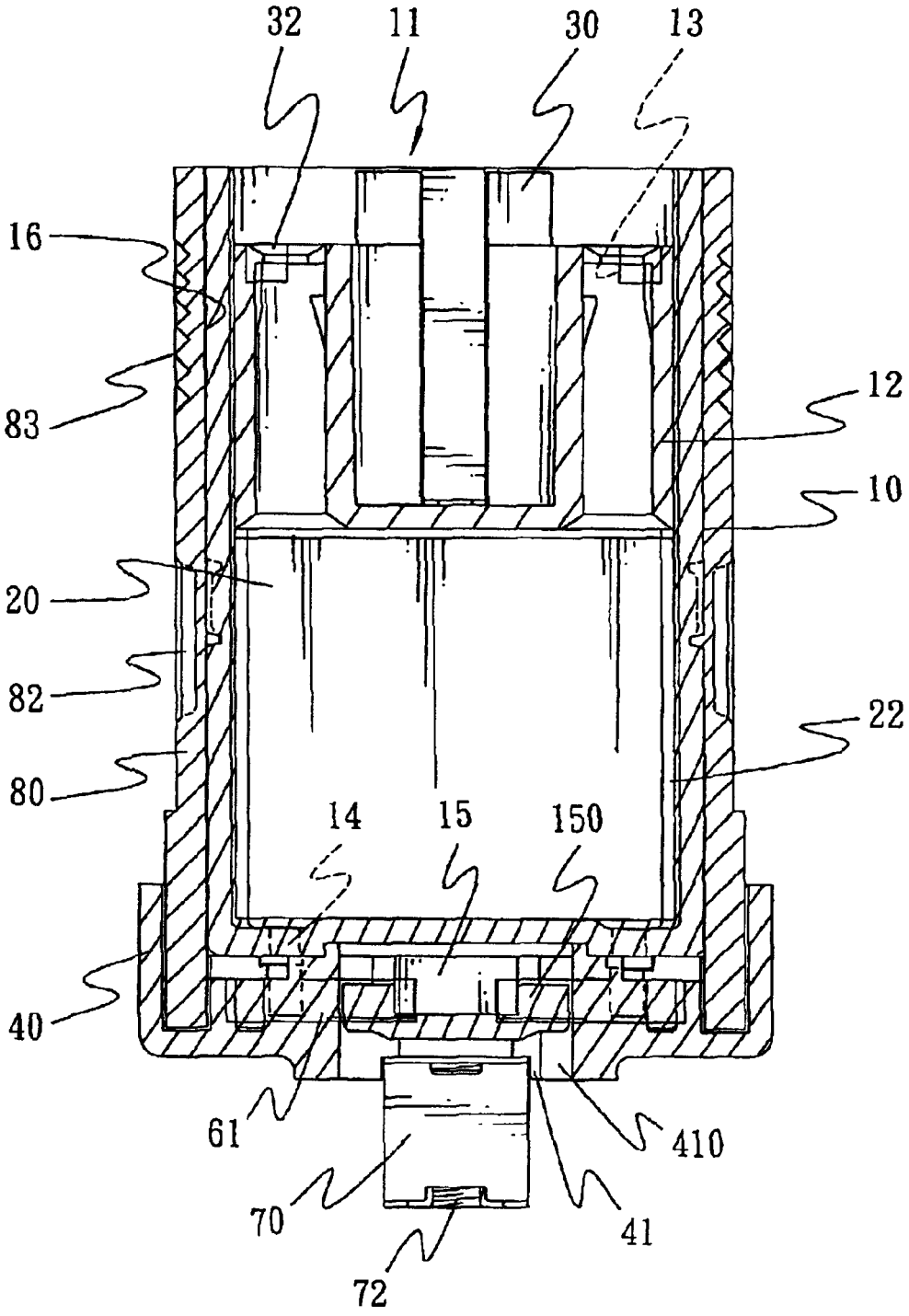
FIG. 4 is a side plan cross-sectional assembly view of the separation device of an electronic stabilizer body and a fixing seat as shown in FIG. 3.
Figure 5:
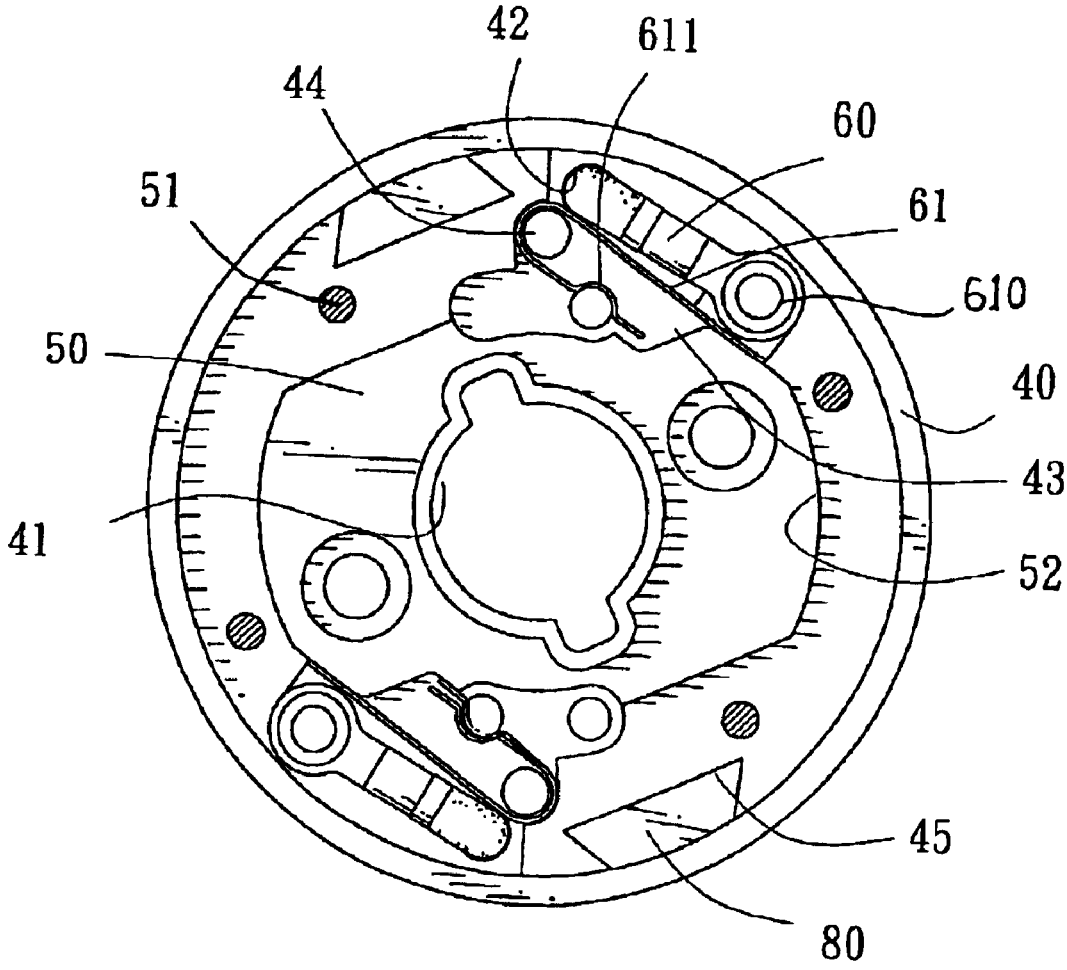
FIG. 5 is a top plan cross-sectional assembly view of the separation device of an electronic stabilizer body and a fixing seat as shown in FIG. 3.

Referring to the drawings and initially to FIGS. 1–5, a separation device of an electronic stabilizer body and a fixing seat in accordance with a first embodiment of the present invention is mounted in a lamp.

As shown in FIG. 1, the lamp includes a shade seat 91A, a shade 93A mounted on the bottom of the shade seat 91A, a fixing device 92A mounted in the shade seat 91A, and a lamp body 94A mounted in the shade 93A. The separation device of an electronic stabilizer body and a fixing seat in accordance with the present invention is mounted between the lamp body 94A and the shade seat 91A, and may be detached and replaced.

Referring to FIGS. 2–5, the separation device of an electronic stabilizer body and a fixing seat in accordance with the first embodiment of the present invention comprises a body 10, an electronic stabilizer 20, a socket 30, a fixing seat 40, a cover plate 50, a fixing bracket 70, and two safety locking members 80.

The body 10 has an inner wall formed with a receiving chamber 11 for receiving the electronic stabilizer 20 and the socket 30. The inner wall of the body 10 is provided with multiple protruding urging portions 12 for urging an end portion of the socket 30.

The electronic stabilizer 20 is received in the receiving chamber 11 of the body 10, and is provided with multiple electrodes 21. The electronic stabilizer 20 is provided with two connecting wires 22. The receiving chamber 11 of the body 10 has a closed end provided with two metallic conductive members 14 each connected to one of the two connecting wires 22 of the electronic stabilizer 20 and each connected to one of two conductive elastic plates 61 in the fixing seat 40.

The socket 30 is received in the receiving chamber 11 of the body 10, and is rested on the electronic stabilizer 20. The socket 30 may be connected to the fixing device 92A of the lamp as shown in FIG. 1. The inner wall of the body 10 is provided with multiple recessed locking portions 13. The socket 30 has a periphery provided with multiple elastic hook-shaped locking portions 31 each elastically locked in one of the multiple recessed locking portions 13 of the body 10, so that the socket 30 may be secured in the receiving chamber 11 of the body 10 exactly. The socket 30 has a back face closely rested on the electrodes 21 of the electronic stabilizer 20 to connect the electric power.

The fixing seat 40 has a first end locked on a closed end of the body 10. The closed end of the body 10 is provided with a protruding guide column 15 which is provided with two radially opposite locking portions 150. The first end of the fixing seat 40 has a center formed with a guide hole 41 for receiving the guide column 15 of the body 10. The guide hole 41 of the fixing seat 40 has a wall formed with two radially opposite recessed limit portions 410 for retaining each of the two locking portions 150 of the guide column 15 of the body 10. Thus, when the guide column 15 of the body 10 is inserted into the guide hole 41 of the fixing seat 40, the body 10 may be rotated relative to the fixing seat 40, thereby inserting and locking each of the two locking portions 150 of the guide column 15 of the body 10 into one of the respective limit portions 410 the guide hole 41 of the fixing seat 40, so that the body 10 may be integrally combined with the fixing seat 40.

The first end of the fixing seat 40 has a periphery formed with two opposite passage holes 42 for passage of two electric wires 60, and formed with two opposite receiving recesses 43 (see FIG. 5) each located beside one of the two opposite passage holes 42. Each of the two opposite receiving recesses 43 is provided with a limit post 44. Each of the two conductive elastic plates 61 is mounted on the limit post 44 of one of the two opposite receiving recesses 43 of the fixing seat 40.

Each of the two conductive elastic plates 61 has a first end provided with a ring-shaped connecting portion 610 connected to one of the two electric wires 60, and a second end provided with an elastic locking portion 611 connected to one of the two metallic conductive members 14 of the body 10.

The cover plate 50 is mounted on the first end of the fixing seat 40, thereby preventing the conductive elastic plates 61 of the electric wires 60 from being exposed outward. The cover plate 50 is formed with a passage slot 52 for passage of the guide column 15 of the body 10, and has a periphery provided with multiple protruding positioning portions 51 positioned in the fixing seat 40, so that the cover plate 50 may be integrally combined with the fixing seat 40.

The fixing bracket 70 is secured on a second end of the fixing seat 40. The fixing bracket 70 has two ends each formed with a screw bore 71, so that each of two fixing bolts 710 is in turn extended through the fixing seat 40 and is screwed into the screw bore 71 of the fixing bracket 70, thereby fixing the fixing bracket 70 on the fixing seat 40. The fixing bracket 70 has a center formed with a threaded passage hole 72 for passage of the electric wires 60. The fixing bracket 70 may be combined with other part by the threaded passage hole 72.

Each of the two safety locking members 80 is mounted between the body 10 and the fixing seat 40, so that the body 10 and the fixing seat 40 may be locked with each other, thereby integrally combining the body 10 with the fixing seat 40.

The body 10 has an outer wall formed with two radially opposite dovetail-shaped guide locking channels 16. The cover plate 50 has an outer wall formed with two radially opposite dovetail-shaped guide locking grooves 53. The fixing seat 40 is formed with two radially opposite dovetail-shaped recessed guide locking portions 45. Each of the two safety locking members 80 has a dovetail-shaped cross-section, and is locked in one of the two dovetail-shaped guide locking channels 16 of the body 10, one of the two dovetail-shaped guide locking grooves 53 of the cover plate 50, and one of the two dovetail-shaped guide locking portions 45 of the fixing seat 40. Each of the two safety locking members 80 has two sides each formed with an oblique locking portion 81.

Each of the two guide locking channels 16 of the body 10 has a wall formed with a limit slot 160. Each of the two safety locking members 80 is provided with an elastic limit portion 82 that may be elastically locked in the limit slot 160 of one of the two guide locking channels 16 of the body 10, so that each of the two, safety locking members 80 may be locked in one of the two guide locking channels 16 of the body 10. Each of the two safety locking members 80 has a surface provided with a serrated push portion 83, thereby facilitating movement of each of the two safety locking members 80.

In assembly, when each of the two guide locking channels 16 of the body 10 is aligned with the respective guide locking portion 45 of the fixing seat 40, each of the two safety locking members 80 may be moved in the respective guide locking channel 16 of the body 10 until the elastic limit portion 82 of each of the two safety locking members 80 is locked in the limit slot 160 of the respective guide locking channel 16 of the body 10, so that each of the two safety locking members 80 may be locked in the respective guide locking channel 16 of the body 10, and may be locked in the respective guide locking portion 45 of the fixing seat 40.

In such a manner, each of the two safety locking members 80 is fully hidden into the respective guide locking channel 16 of the body 10 and the respective guide locking portion 45 of the fixing seat 40, so that each of the two safety locking members 80 will not protrude from the socket 30, thereby facilitating the socket 30 combining with the fixing device 92A (see FIG. 1). If each of the two safety locking members 80 is not exactly inserted into the respective guide locking portion 45 of the fixing seat 40, each of the two safety locking members 80 will protrude from the socket 30, so that the socket 30 cannot combine with the fixing device 92A.

Figure 6:
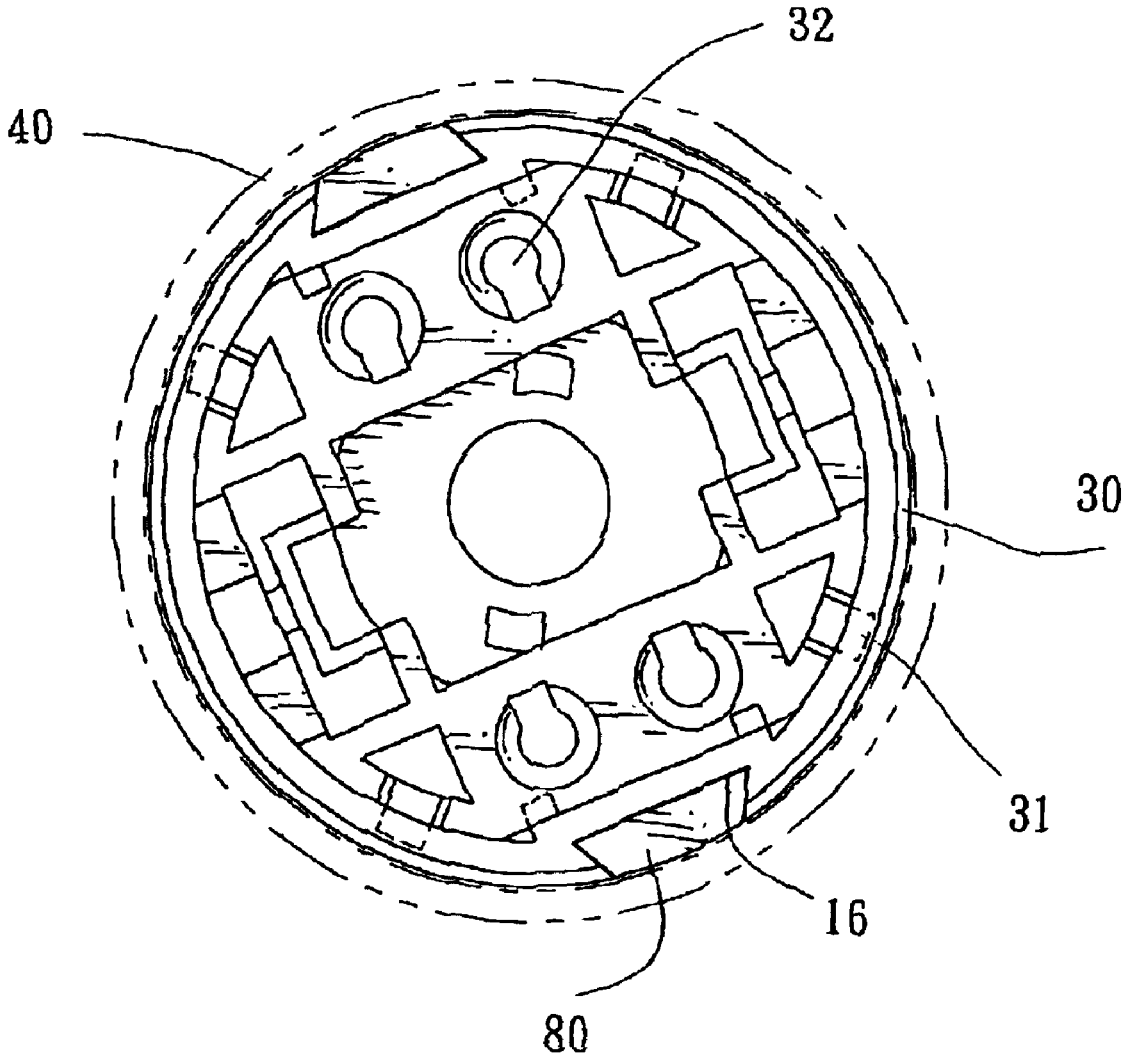
FIG. 6 is a another top plan cross-sectional assembly view of the separation device of an electronic stabilizer body and a fixing seat as shown in FIG. 3.

Referring to FIG. 6, the socket 30 is formed with multiple insertion holes 32, so that the socket 30 may be available for different kinds of lamps or appliances, thereby enhancing the versatility of the present invention.

Figure 7:
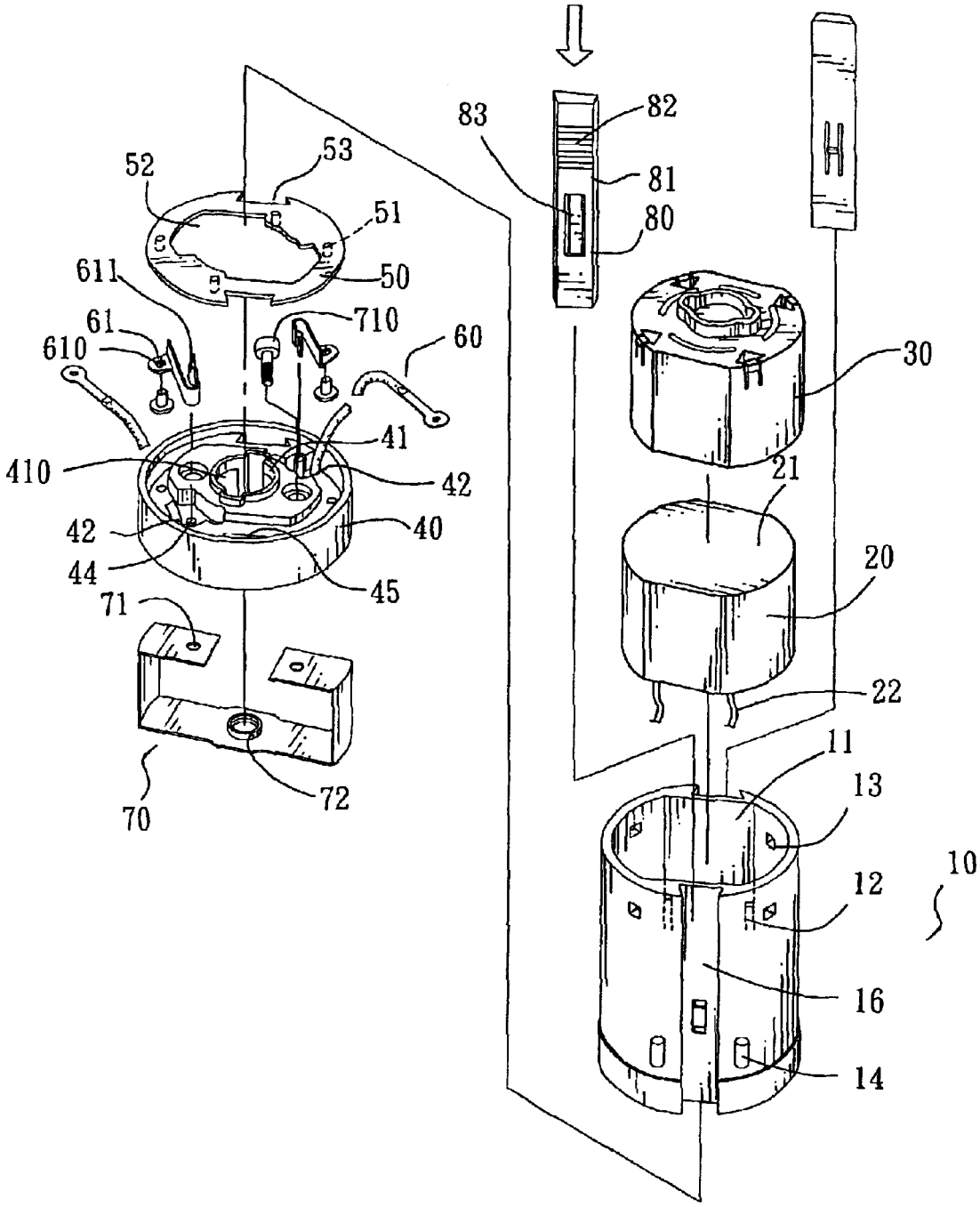
FIG. 7 is an exploded perspective view of a separation device of an electronic stabilizer body and a fixing seat in accordance with a second embodiment of the present invention.
Figure 8:
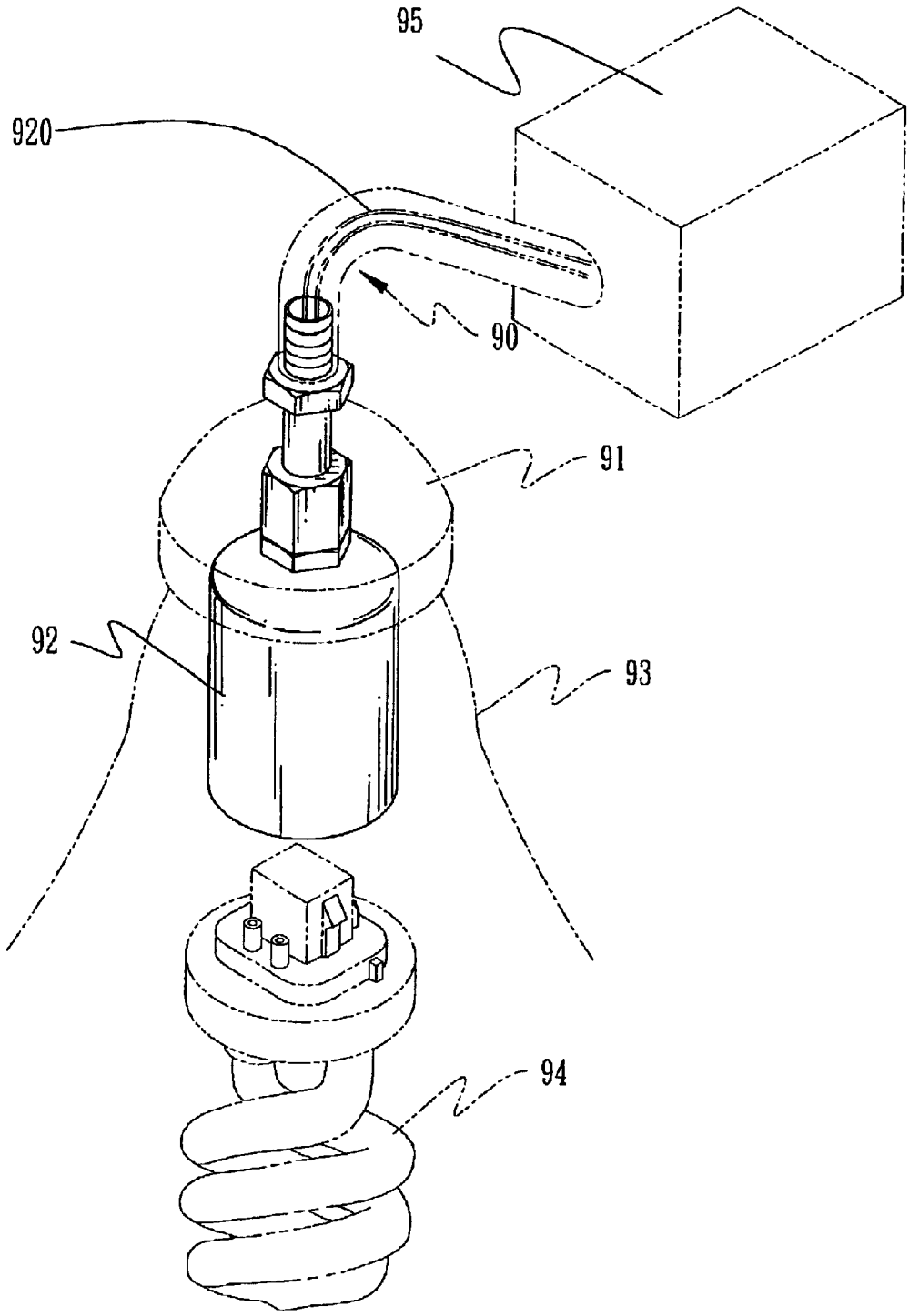
FIG. 8 PRIOR ART
FIG. 8 is a perspective view of a conventional lamp in accordance with the prior art.

Referring to FIG. 7, the separation device of an electronic stabilizer body and a fixing seat in accordance with a second embodiment of the present invention is shown.

Accordingly, the separation device of an electronic stabilizer body and a fixing seat in accordance with the present invention has the following advantages.

1. The body 10 may be rotated relative to the fixing seat 40, thereby inserting and locking each of the two locking portions 150 of the guide column 15 of the body 10 into the respective limit portion 410 the guide hole 41 of the fixing seat 40, so that the body 10 may be integrally combined with the fixing seat 40, so that the separation device of the present invention may be assembled and disassembled easily and conveniently.

2. Each of the two safety locking members 80 may be exactly locked on the body 10 and the fixing seat 40 when the body 10 is aligned with the fixing seat 40, so that the separation device of the present invention may be assembled and disassembled easily and conveniently.

3. The main electronic parts are mounted in the body 10, thereby facilitating replacement and maintenance of the separation device of the present invention.

4. The body 10 and the fixing seat 40 may be assembled and disassembled easily and conveniently, thereby facilitating replacement and maintenance of the separation device of the present invention.

5. The fixing device 92A of the lamp may be mounted on the socket 30 only when each of the two safety locking members 80 is fully hidden into the body 10 and the fixing seat 40, thereby ensuring the stability and rigidity of the separation device of the present invention.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body for mounting to a lighting fixture; and each of the two safety locking members is mounted and locked between the body and the fixing seat in displaceable manner, so that the body and the fixing seat may be locked with each other, thereby integrally combining the body with the fixing seat.

2. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body; and each of the two safety locking members is mounted and locked between the body and the fixing seat, so that the body and the fixing seat may be locked with each other, thereby integrally combining the body with the fixing seat;

wherein the inner wall of the body is provided with multiple protruding urging portions for urging an end portion of the socket.

3. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body; and each of the two safety locking members is mounted and locked between the body and the fixing seat, so that the body and the fixing seat may be locked with each other, thereby integrally combining the body with the fixing seat;

wherein the electronic stabilizer is provided with multiple electrodes, and two connecting wires, and the socket has a back face closely rested on the electrodes of the electronic stabilizer to connect to electric power.

4. The separation device of an electronic stabilizer body and a fixing seat in accordance with claim 3, wherein the receiving chamber of the body has a closed end provided with two metallic conductive members each connected to one of the two connecting wires of the electronic stabilizer and each connected to one of two conductive elastic plates in the fixing seat.

5. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body; and each of the two safety locking members is mounted and locked between the body and the fixing seat, so that the body and the fixing seat may be locked with each other, thereby integrally combining the body with the fixing seat;

wherein the inner wall of the body is provided with multiple recessed locking portions, and the socket has a periphery provided with multiple elastic hook-shaped locking portions each elastically locked in one of the multiple recessed locking portions of the body, so that the socket may be secured in the receiving chamber of the body exactly.

6. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body; and each of the two safety locking members is mounted and locked between the body and the fixing seat, so that the body and the fixing seat may be locked with each other, thereby integrally combining the body with the fixing seat;

wherein the closed end of the body is provided with a protruding guide column which is provided with two radially opposite locking portions, the fixing seat has a center formed with a guide hole for receiving the guide column of the body, and the guide hole of the fixing seat has a wall formed with two radially opposite recessed limit portions for retaining each of the two locking portions of the guide column of the body.

7. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body; and each of the two safety locking members is mounted and locked between the body and the fixing seat, so that the body and the fixing seat may be locked with each other, thereby integrally combining the body with the fixing seat;

wherein the fixing seat has a periphery formed with two opposite passage holes for passage of two electric wires, and formed with two opposite receiving recesses each located beside one of the two opposite passage holes, each of the two opposite receiving recesses is provided with a limit post, each of the two conductive elastic plates is mounted on the limit post of one of the two opposite receiving recesses of the fixing seat, and each of the two conductive elastic plates has a first end provided with a ring-shaped connecting portion connected to one of the two electric wires, and a second end provided with an elastic locking portion connected to one of the two metallic conductive members of the body.

8. The separation device of an electronic stabilizer body and a fixing seat in accordance with claim 6, further comprising a cover plate mounted on the fixing seat, thereby preventing the conductive elastic plates of the electric wires from being exposed outward, wherein the cover plate is formed with a passage slot for passage of the guide column of the body and has a periphery provided with multiple protruding positioning portions positioned in the fixing seat, so that the cover plate may be integrally combined with the fixing seat.

9. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body;

each of the two safety locking members is mounted and locked between the body and the fixing seat, so that the body and the fixing seat may be locked with each other, thereby integrally combining the body with the fixing seat: and, a fixing bracket secured on a second end of the fixing seat, wherein the fixing bracket has two ends each formed with a screw bore, so that each of the two fixing bolts is in turn extended through the fixing seat and is screwed into the screw bore at the fixing bracket, thereby fixing the fixing bracket on the fixing seat.

10. The separation device of an electronic stabilizer body and a fixing seat in accordance with claim 9, wherein the fixing bracket has a center formed with a threaded passage hole for passage of electric wires.

11. A separation device of an electronic stabilizer body and a fixing seat, comprising a body, an electronic stabilizer, a socket, a fixing seat, and two safety locking members, wherein:

the body has an inner wall formed with a receiving chamber;

the electronic stabilizer is received in the receiving chamber of the body;

the socket is received in the receiving chamber of the body, and is rested on the electronic stabilizer;

the fixing seat has one end locked on a closed end of the body; and each of the two safety locking members is mounted and locked between the body and the fixing seat, so that the body and the fixing seat may be locked with each other, thereby integrally combining the body with the fixing seat;

wherein the body has an outer wall formed with two radially opposite dovetail-shaped guide locking channels, the fixing seat is formed with two radially opposite dovetail-shaped recessed guide locking portions, and each of the two safety locking members has a dovetail-shaped cross-section, and is locked in one of the two dovetail-shaped guide locking channels of the body, and one of the two dovetail-shaped guide locking portions of the fixing seat.

12. The separation device of an electronic stabilizer body and a fixing seat iii accordance with claim 11, wherein each of the two guide locking channels of the body has a wall formed with a limit slot, and each of the two safety locking members is provided with an elastic limit portion that may be elastically locked in the limit slot of one of the two guide locking channels of the body, so that each of the two safety locking members may be locked in one of the two guide locking channels of the body.

13. The separation device of an electronic stabilizer body and a fixing seat in accordance with claim 1, wherein each of the two safety locking members has two sides each formed with an oblique locking portion.

14. The separation device of an electronic stabilizer body and a fixing seat in accordance with claim 1, wherein each of the two safety locking members has a surface provided with a serrated push portion, thereby facilitating movement of each of the two safety locking members.

15. The separation device of an electronic stabilizer body and a fixing seat in accordance with claim 8, wherein the cover plate has an outer wall formed with two radially opposite dovetail-shaped guide locking grooves.

16. The separation device of an electronic stabilizer body and a fixing seat in accordance with claim 1, wherein the socket is formed with multiple insertion holes.

* * * * *